US010923265B2

(12) United States Patent
Kim

(10) Patent No.: US 10,923,265 B2
(45) Date of Patent: Feb. 16, 2021

(54) COIL COMPONENT

(71) Applicant: SAMSUNG ELECTRO-MECHANICS CO., LTD., Suwon-Si (KR)

(72) Inventor: Sang Seob Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 306 days.

(21) Appl. No.: 15/970,355

(22) Filed: May 3, 2018

(65) Prior Publication Data

US 2019/0198223 A1 Jun. 27, 2019

(30) Foreign Application Priority Data

Dec. 26, 2017 (KR) ..... 10-2017-0179738

(51) Int. Cl.

| | |
|---|---|
| ***H01F 17/00*** | (2006.01) |
| ***H01F 27/28*** | (2006.01) |
| ***H01F 27/29*** | (2006.01) |
| ***H01F 27/32*** | (2006.01) |
| ***H01F 17/04*** | (2006.01) |

(Continued)

(52) U.S. Cl.

CPC ..... *H01F 27/2804* (2013.01); *H01F 1/14* (2013.01); *H01F 17/0013* (2013.01); *H01F 17/0033* (2013.01); *H01F 17/04* (2013.01); *H01F 27/292* (2013.01); *H01F 27/324* (2013.01); *H01F 41/041* (2013.01); *H01F 2017/048* (2013.01)

(58) Field of Classification Search

CPC ..... H01F 27/2804; H01F 1/14; H01F 17/0013
See application file for complete search history.

(56) References Cited

U.S. PATENT DOCUMENTS

| | | | |
|---|---|---|---|
| 9,396,874 B2 | 7/2016 | Nakamura et al. | |
| 2009/0051474 A1* | 2/2009 | Lee | H01F 17/0013 336/83 |

(Continued)

FOREIGN PATENT DOCUMENTS

| | | |
|---|---|---|
| CN | 104575987 A | 4/2015 |
| JP | 2010-16143 A | 1/2010 |

(Continued)

OTHER PUBLICATIONS

Office Action issued in corresponding Korean Application No. 10-2017-0179738, dated Apr. 4, 2019.

(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil component includes: a body portion; and a coil portion disposed in the body portion, wherein the coil portion includes a support member and a first coil layer disposed on a first surface of the support member, the first coil layer including a first electrode portion led out to a first end surface of the body portion, the support member includes first and second insulators and a metal core disposed between the first and second insulators, and a first end portion of the metal core is led out to the first end surface of the body portion to which the first electrode portion of the first coil layer is led.

19 Claims, 7 Drawing Sheets

(51) Int. Cl.
*H01F 1/14* (2006.01)
*H01F 41/04* (2006.01)

(56) References Cited

U.S. PATENT DOCUMENTS

| | | | | |
|---|---|---|---|---|
| 2013/0263440 | A1* | 10/2013 | Lee | H01F 41/127 29/605 |
| 2014/0145812 | A1* | 5/2014 | Lee | H01F 41/041 336/200 |
| 2015/0102890 | A1 | 4/2015 | Nakamura et al. | |
| 2015/0130021 | A1* | 5/2015 | Kim | H01L 28/10 257/531 |
| 2015/0380152 | A1* | 12/2015 | Itoh | H01F 41/041 336/200 |
| 2016/0141101 | A1* | 5/2016 | Itoh | H01F 41/041 29/605 |
| 2016/0276094 | A1* | 9/2016 | Lee | H01F 27/324 |
| 2017/0178798 | A1 | 6/2017 | Yoon et al. | |
| 2017/0345556 | A1 | 11/2017 | Kim et al. | |

FOREIGN PATENT DOCUMENTS

| | | | |
|---|---|---|---|
| KR | 10-2014-0066437 | A | 6/2014 |
| KR | 10-2015-0042722 | A | 4/2015 |
| KR | 10-2017-0073174 | A | 6/2017 |
| KR | 10-2017-0133140 | A | 12/2017 |

OTHER PUBLICATIONS

Office Action issued in corresponding Chinese Patent Application No. 201810895703.3 dated Oct. 12, 2020, with English translation.

* cited by examiner

COIL COMPONENT

CROSS-REFERENCE TO RELATED APPLICATION(S)

This application claims the benefit of priority to Korean Patent Application No. 10-2017-0179738, filed on Dec. 26, 2017 in the Korean Intellectual Property Office, the disclosure of which is incorporated herein by reference in its entirety.

BACKGROUND

1. Field

The present disclosure relates to a coil component such as a power inductor.

2. Description of Related Art

Recently, in accordance with the development of information technology (IT), supplementary services such as Internet shopping, financial transactions, and the like, using smartphones have increased. In order to increase service areas for smartphone usage, the implementation of components having high efficiency and high functionality has been demanded, and components having high reliability have also been demanded, due to various functions.

An existing thin film power inductor may be manufactured by manufacturing a coil substrate using a copper clad laminate (CCL), implementing electrical conduction between upper and lower portions of the coil substrate through a via, applying an insulating sheet to the coil substrate to implement a body, dicing the body in chip form, and then forming external electrodes on end surfaces of the respective bodies. The thin film power inductor transfers a signal to an external component through the external electrodes after a set is assembled.

However, the risk of an open defect may be present after the set is assembled due to insufficiency of coupling force between the external electrode and a diced surface of a chip depending on a state of the diced surface at the time of applying the external electrode.

SUMMARY

An aspect of the present disclosure may provide a coil component in which high reliability may be secured, since a possibility of an open defect may be suppressed.

According to an aspect of the present disclosure, a coil component may be provided, in which a metal core is introduced as a support member for forming a coil layer and an end portion of the metal core is exposed to an end surface of a body portion to be thus used as an auxiliary electrode.

According to an aspect of the present disclosure, a coil component includes: a body portion; and a coil portion disposed in the body portion. The coil portion includes a support member and a first coil layer disposed on a first surface of the support member, the first coil layer including a first electrode portion led out to a first end surface of the body portion, the support member includes first and second insulators and a metal core disposed between the first and second insulators, and a first end portion of the metal core is led out to the first end surface of the body portion to which the first electrode portion of the first coil layer is led.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
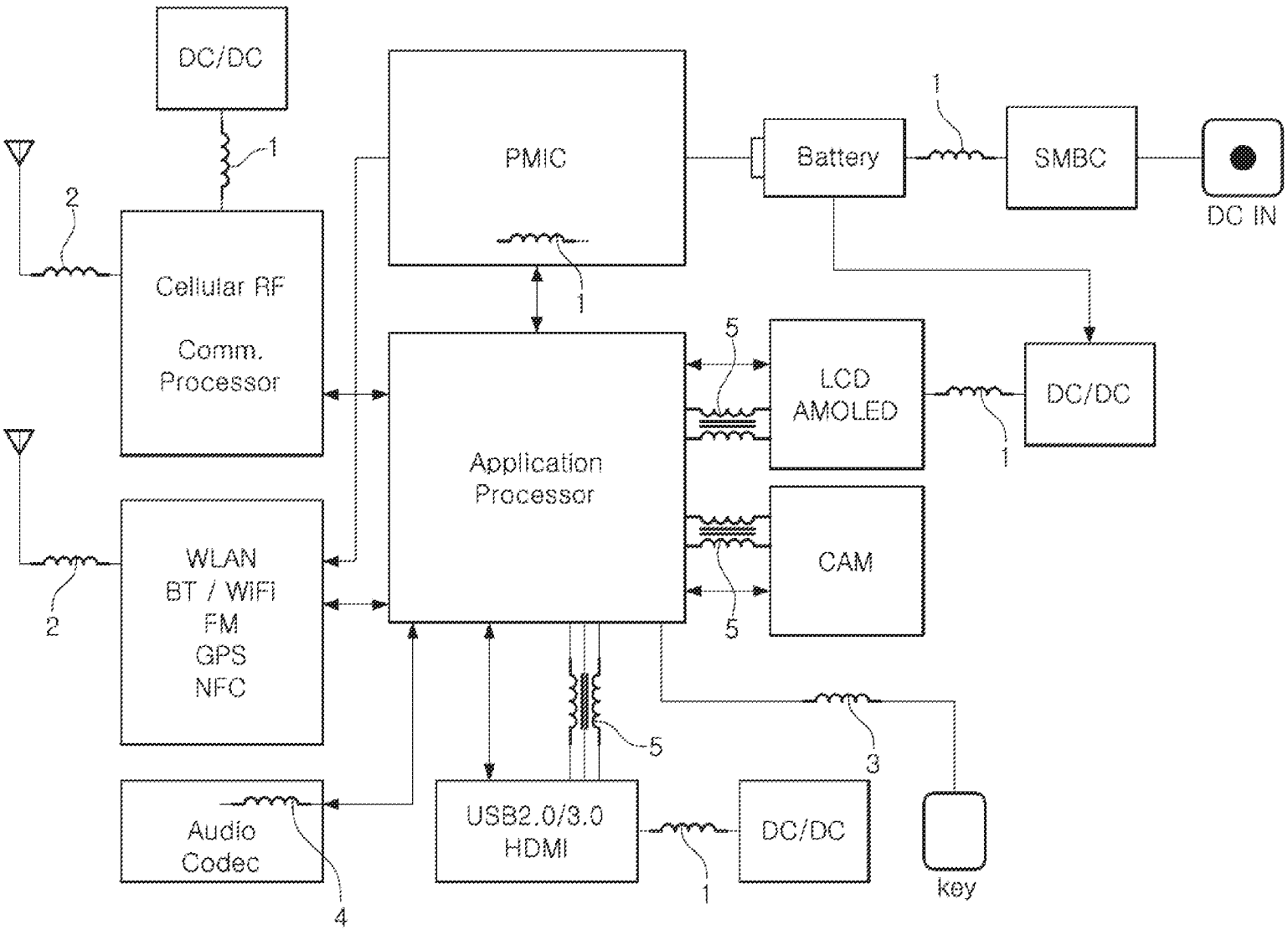
FIG. 1 is a schematic view illustrating an example of a coil component used in an electronic device.

Hereinafter, exemplary embodiments in the present disclosure will be described in more detail with reference to the accompanying drawings. In the drawings, shapes, sizes, and the like, of components may be exaggerated for clarity.

Meanwhile, herein, "electrically connected" conceptually includes a physical connection and a physical disconnection. It can be understood that when an element is referred to with terms such as "first" and "second", the element is not limited thereby. They may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

In addition, the term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with one another. For example, one element described in a particular exemplary embodiment, even if it is not described in another exemplary embodiment, may be understood as a description related to another exemplary embodiment, unless an opposite or contradictory description is provided therein.

In addition, terms used herein are used only in order to describe an exemplary embodiment rather than limiting the present disclosure. In this case, singular forms include plural forms unless interpreted otherwise in context.

Electronic Device

FIG. 1 is a schematic view illustrating an example of a coil component used in an electronic device.

Referring to FIG. 1, it may be appreciated that various kinds of electronic components are used in an electronic device. For example, an application processor, a direct current (DC) to DC converter, a communications processor, a wireless local area network Bluetooth (WLAN BT)/wireless fidelity frequency modulation global positioning system near field communications (WiFi FM GPS NFC), a power management integrated circuit (PMIC), a battery, a SMBC, a liquid crystal display active matrix organic light emitting diode (LCD AMOLED), an audio codec, a universal serial bus (USB) 2.0/3.0 a high definition multimedia interface (HDMI), a CAM, and the like, may be used. In this case, various kinds of coil components may be appropriately used between these electronic components depending on their purposes in order to remove noise, or the like. For example, a power inductor 1, high frequency (HF) inductors 2, a general bead 3, a bead 4 for a high frequency (GHz), common mode filters 5, and the like, may be used.

In detail, the power inductor 1 may be used to store electricity in a magnetic field form to maintain an output voltage, thereby stabilizing power. In addition, the high frequency (HF) inductor 2 may be used to perform impedance matching to secure a required frequency or cut off noise and an alternating current (AC) component. Further, the general bead 3 may be used to remove noise of power and signal lines or remove a high frequency ripple. Further, the bead 4 for a high frequency (GHz) may be used to remove high frequency noise of a signal line and a power line related to an audio. Further, the common mode filter 5 may be used to pass a current therethrough in a differential mode and remove only common mode noise.

An electronic device may be typically a smartphone, but is not limited thereto. The electronic device may also be, for example, a personal digital assistant, a digital video camera, a digital still camera, a network system, a computer, a monitor, a television, a video game, or a smartwatch. The electronic device may also be various other electronic devices well-known in those skilled in the art, in addition to the devices described above.

Coil Component

Hereinafter, a coil component according to the present disclosure, particularly, an inductor will be described for convenience. However, the coil component according to the present disclosure may also be applied to the coil components for various purposes as described above. Meanwhile, herein, a side portion is used to refer to a direction toward a first direction or a second direction for convenience, an upper portion is used to refer to a direction toward a third direction for convenience, and a lower portion is to refer to a direction toward an opposite direction to the third direction for convenience. In addition, "positioned on the side portion, above, or below" conceptually includes a case in which a target component is positioned in a corresponding direction, but does not be in direct contact with a reference component, as well as a case in which the target component is in direct contact with the reference component in the corresponding direction. However, these directions are defined for convenience of explanation, and the claims are not particularly limited by the directions defined as described above.

Figure 2:
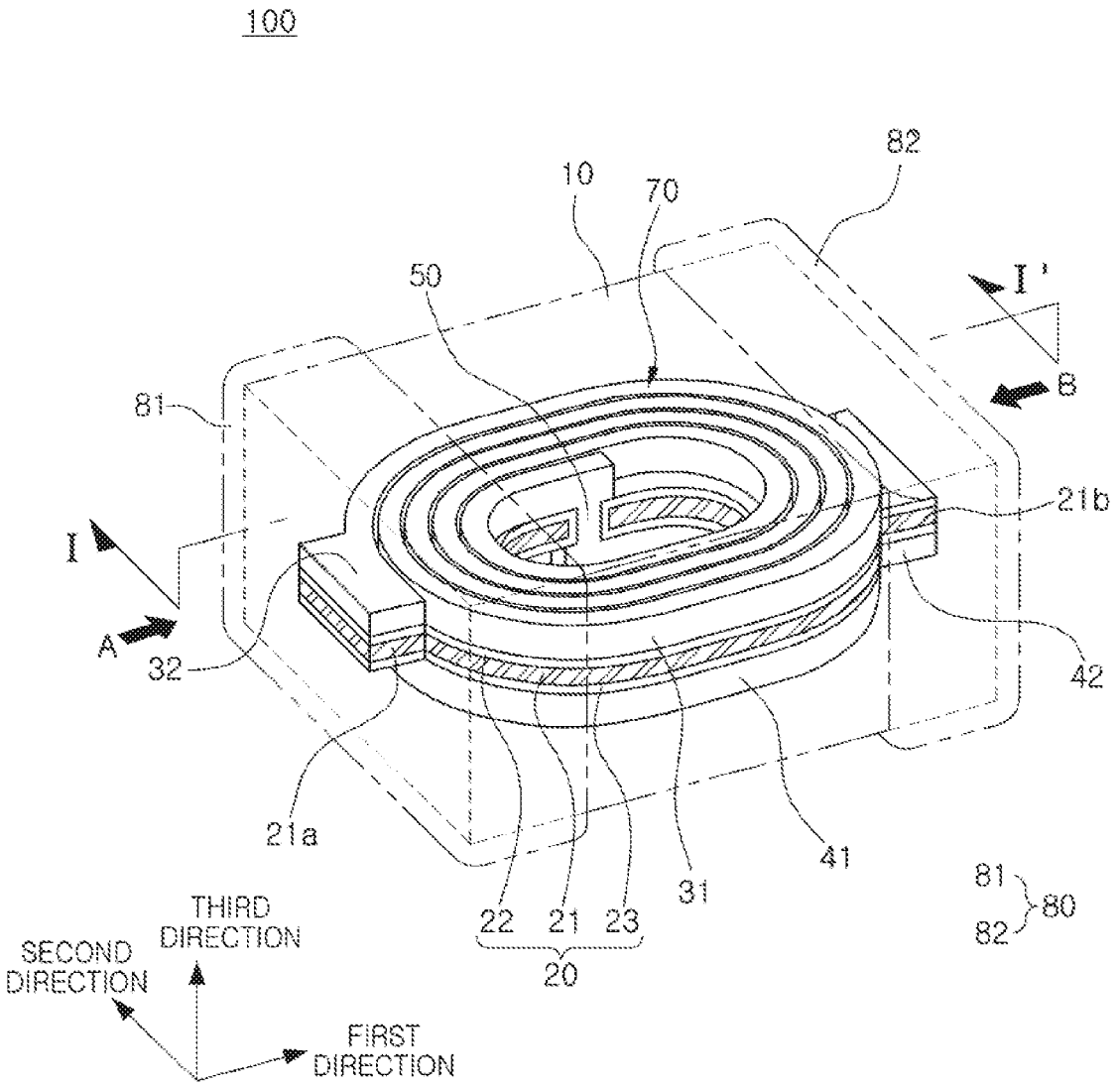
FIG. 2 is a schematic perspective view illustrating an example of a coil component.

FIG. 2 is a schematic perspective view illustrating an example of a coil component.

Figure 3:
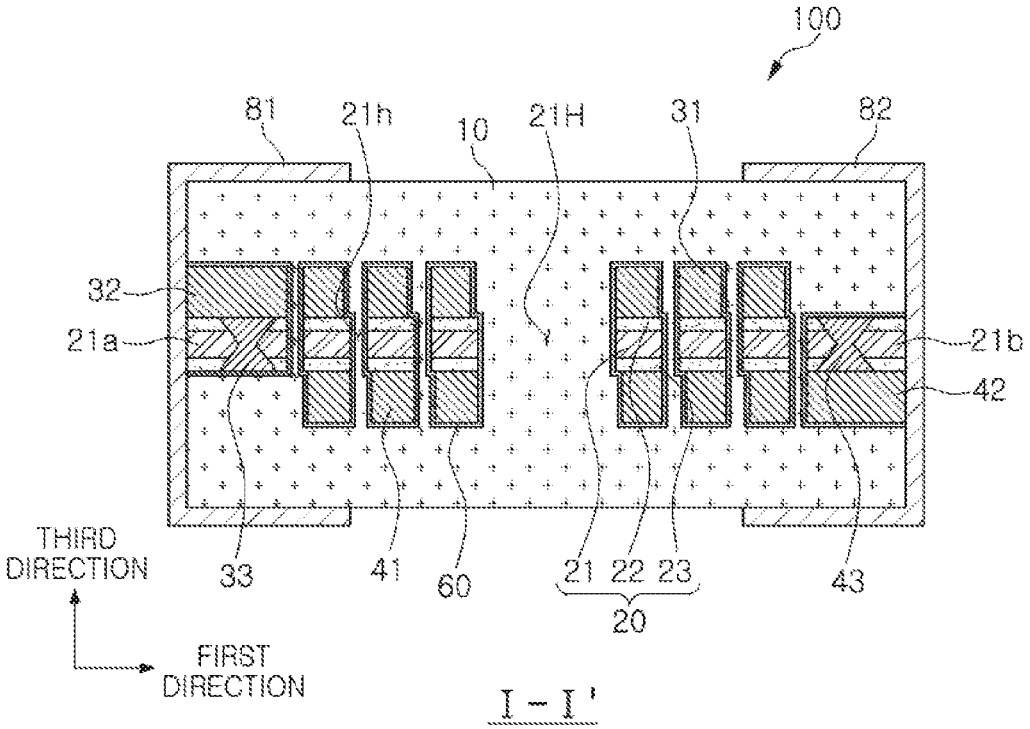
FIG. 3 is a schematic cross-sectional view taken along line I-I' of the coil component of FIG. 2.

FIG. 3 is a schematic cross-sectional view taken along line I-I' of the coil component of FIG. 2.

Figure 4:
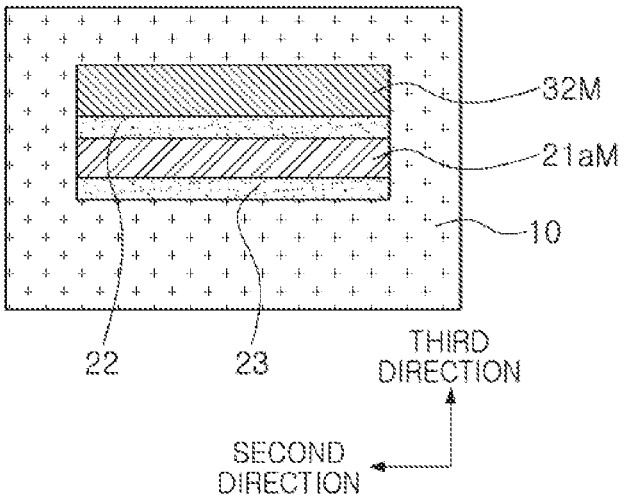
FIGS. 4 and 5 are schematic views illustrating examples of a body portion of the coil component of FIG. 2 when viewed in direction A and direction B, respectively.
Figure 5:
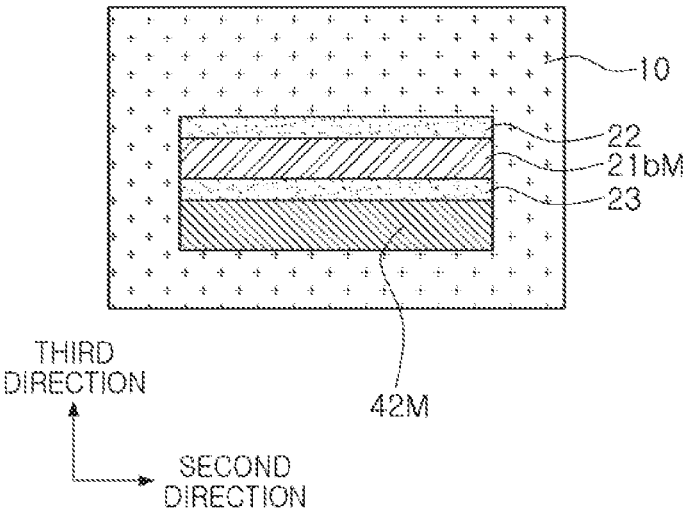

FIGS. 4 and 5 are schematic views illustrating examples of a body portion of the coil component of FIG. 2 when viewed in direction A and direction B, respectively.

Referring to FIGS. 2 through 5, a coil component 100 according to an exemplary embodiment in the present disclosure may include a body portion 10, a coil portion 70 disposed in the body portion 10, and an electrode portion 80 disposed on the body portion 10. The coil portion 70 may include a support member 20, a first coil layer 31 disposed on a first surface of the support member 20 and having a first electrode portion 32 led out to a first end surface of the body portion 10, and a second coil layer 41 disposed on a second surface of the support member 20 opposing the first surface and having a second electrode portion 42 led out to a second end surface of the body portion 10 opposing the first end surface. The support member 20 may include a first insulator 22 and a second insulator 23 and a metal core 21 disposed between the first insulator 22 and the second insulator 23. The metal core 21 may have a first end portion 21*a* and a second end portion 21*b*. The first end portion 21*a* may be led out to the first end surface of the body portion 10 to which the first electrode portion 32 of the first coil layer 31 is led, and the second end portion 21*b* may be led out to the second end surface of the body portion 10 to which the second electrode portion 42 of the second coil layer 41 is led. The electrode portion 80 may include a first external electrode 81 disposed on the first end surface of the body portion 10 and a second external electrode 82 disposed on the second end surface of the body portion 10. The first external electrode 81 may be electrically connected to the first electrode portion 32 of the first coil layer 31 and the first end portion 21*a* of the metal core 21, and the second external electrode 82 may be electrically connected to the second electrode portion 42 of the second coil layer 41 and the second end portion 21*b* of the metal core 21. For example, a first electrode surface 32M to which the first electrode portion 32 of the first coil layer 31 is exposed and a first auxiliary electrode surface 21*a*M to which the first end portion 21*a* of the metal core 21 is exposed may be disposed on one end surface of the body portion 10 to be spaced apart from each other by a predetermined distance, and the first electrode surface 32M and the first auxiliary electrode surface 21*a*M may be electrically connected to the first external electrode 81 disposed on one end surface of the body portion 10. In addition, a second electrode surface 42M to which the second electrode portion 42 of the second coil layer 41 is exposed and a second auxiliary electrode surface 21*b*M to which the second end portion 21*b* of the metal core 21 is exposed may be disposed on the other end surface of the body portion 10 to be spaced apart from each other by a predetermined distance, and the second electrode surface 42M and the second auxiliary electrode surface 21*b*M may be connected to the second external electrode 82.

As described above, the thin film power inductor according to the related art is manufactured by manufacturing the coil substrate using the copper clad laminate (CCL), implementing the electrical conduction between the upper and lower portions of the coil substrate through the via, applying the insulating sheet to the coil substrate to implement the body, dicing the body in the chip form, and then forming the external electrodes on the end surfaces of the respective bodies. However, the risk of an open defect often occurs after the set is assembled due to the insufficiency of the coupling force between the external electrode and the diced surface depending on the state of the diced surface at the time of applying the external electrode.

On the other hand, in the coil component 100 according to the exemplary embodiment, the first and second end portions 21*a* and 21*b* of the metal core 21 may also be exposed to opposite end surfaces of the body portion 10 coupled out to the first and second external electrodes 81 and 82, respectively. The first and second end portions 21*a* and 21*b* of the metal core 21 that are exposed may serve as the first and second auxiliary electrode surfaces 21*a*M and 21*b*M, respectively. In this case, a contact area between conductors may be increased as compared to a case in which only the first and second electrode portions 32 and 42 of the first and second coil layers 31 and 41 are exposed to provide only the first and second electrode surfaces 32M and 42M, and the risk of an open defect, which is problematic in the related art, may thus be suppressed. That is, higher reliability of the coil component may be implemented regardless of the state of the diced surface of the body portion 10.

Meanwhile, the coil portion 70 may further include a first through-via 33 penetrating through the support member 20 and connected to the first electrode portion 32 of the first coil layer 31 and the first end portion 21*a* of the metal core 21 and a second through-via 43 penetrating through the support member 20 and connected to the second electrode portion 42 of the second coil layer 41 and the second end portion 21*b* of the metal core 21. The first electrode portion 32 and the first end portion 21*a* may be electrically connected to each other through the first through-via 33, and the second electrode portion 42 and the second end portion 21*b* may be electrically connected to each other through the second through-via 43. In this case, the first and second end portions 21*a* and 21*b* of the metal core 21 may provide the first and second auxiliary electrode surfaces 21*a*M and 21*b*M, respectively, to increase the contact area between the conductors, and may be actually used as auxiliary electrodes of the first and second coil layers 31 and 41, respectively.

Meanwhile, in the coil component 100 according to the exemplary embodiment, the support member 20 include the metal core 21, and rigidity of the coil component 100 may thus be sufficiently maintained even in a case in which the support member 20 is implemented in a small thickness. In addition, as seen from a process to be described below, a manner of applying the first and second insulators 22 and 23 to upper and lower surfaces of the metal core 21, respectively, and then forming the first and second coil layer 31 and 41 as circuit layers may be used, and a fine circuit may thus be easily manufactured.

The respective components of the coil component 100 according to the exemplary embodiment will hereinafter be described in more detail.

The body portion 10 may form an appearance of the coil component 100, and may have first and second surfaces opposing each other in the first direction, third and fourth surfaces opposing each other in the second direction, and fifth and sixth surfaces opposing each other in the third direction. The body portion 10 may have a hexahedral chip shape. However, a shape of the body portion 10 is not limited thereto.

The body portion 10 may include a magnetic material. The magnetic material is not particularly limited as long as it has a magnetic property, and may be, for example, Fe alloys such as pure iron powders, Fe—Si-based alloy powders, Fe—Si—Al-based alloy powders, Fe—Ni-based alloy powders, Fe—Ni—Mo-based alloy powders, Fe—Ni—Mo—Cu-based alloy powders, Fe—Co-based alloy powders, Fe—Ni—Co-based alloy powders, Fe—Cr-based alloy powders, Fe—Cr—Si-based alloy powders, Fe—Ni—Cr-based alloy powders, Fe—Cr—Al-based alloy powers, or the like, amorphous alloys such as an Fe-based amorphous alloy, a Co-based amorphous alloy, or the like, spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, or the like, hexagonal ferrites such as Ba—Zn-based ferrite, Ba—Mg-based ferrite, Ba—Ni-based ferrite, Ba—Co-based ferrite, Ba—Ni—Co-based ferrite, or the like, or garnet ferrites such as Y-based ferrite, or the like.

The magnetic material of the body portion 10 may be a magnetic material-resin composite in which metal magnetic powders and a resin mixture are mixed with each other. The metal magnetic powders may include iron (Fe), chromium (Cr), or silicon (Si) as main components. For example, the metal magnetic powders may include iron (Fe)-nickel (Ni), iron (Fe), iron (Fe)-chromium (Cr)-silicon (Si), or the like, but are not limited thereto. The resin mixture may include epoxy, polyimide, liquid crystal polymer (LCP), or the like, but is not limited thereto. The metal magnetic powders may be metal magnetic powders having at least two different average particle sizes. For example, bimodal metal magnetic powders having different sizes may be compressed and fully filled in the magnetic material-resin composite, such that a packing factor of the magnetic material-resin composite may be increased.

The coil portion 70 may implement coil characteristics of the coil component 100. The coil portion 70 may include the support member 20 including the first and second insulators 22 and 23 and the metal core 21 disposed between the first and second insulators 22 and 23; the first coil layer 31 disposed on one surface of the support member 20 and having the first electrode portion 32 led out to the first surface of the body portion 10; the second coil layer 41 disposed on the other surface of the support member 20 and having the second electrode portion 42 led out to the second surface of the body portion 10; and the first and second through-vias 33 and 43 penetrating through the support member 20 and electrically connecting the first and second end portions 21*a* and 21*b* of the metal core 21 to the first and second electrode portions 32 and 42, respectively.

The support member 20 may be provided in order to more thinly and more easily form the first and second coil layers 31 and 41, and may include the first and second insulators 22 and 23 and the metal core 21 disposed between the first and second insulators 22 and 23. Each of the first and second insulators 22 and 23 may include an insulating resin and an inorganic filler. In this case, an example of the insulating resin may include a thermosetting resin such as an epoxy resin and a thermoplastic resin such as a polyimide resin, and an example of the inorganic filler may include silica. However, the insulating resin and the inorganic filler are not limited thereto. In order to further increase rigidity, each of the first and second insulators 22 and 23 may further include a glass fabric (or a glass fiber or a glass cloth), if necessary. A certain example of each of the first and second insulators 22 and 23 may include prepreg, Ajinomoto build-up film (ABF), or the like, but is not limited thereto. The metal core 21 may include any known conductive material such as copper (Cu). The metal core 21 may include the first end portion 21*a* led out to the first surface of the body portion 10 and the second end portion 21*b* led out to the second surface of the body portion 10. The first end portion 21*a* and the second end portion 21*b* of the metal core 21 may be led out to the first surface and the second surface of the body portion 10, respectively, to provide the first auxiliary electrode surface 21*a*M and the second auxiliary electrode surface 21*b*M, respectively. Therefore, adhesion between the first and second external electrodes 81 and 82 and the first and second surfaces of the body portion 10 may be improved.

The first coil layer 31 may be disposed on one surface of the support member 20, and may have a planar spiral shape having a plurality of coil turns. The first coil layer 31 may include a seed layer and a plating layer having a planar spiral shape. A material of each of the seed layer and the plating layer may be a conductive material such as copper (Cu), aluminum (Al), silver (Ag), tin (Sn), gold (Au), nickel (Ni), lead (Pb), or alloys, which is a general plating material. The first coil layer 31 may be formed by anisotropic plating technology. In this case, an aspect ratio (AR), which is a ratio of a height to a line width, may be implemented to have a high numerical value. Alternatively, the first coil layer 31 may be formed by forming one plating layer having a high aspect ratio using partition walls. The first coil layer 31 may have the first electrode portion 32 led out to the first surface of the body portion 10, and the first electrode portion 32 may be led out to the first surface of the body portion 10 to provide the first electrode surface 32M. The first electrode surface 32M may be electrically connected to the first external electrode 81 on the first surface of the body portion 10. The first electrode portion 32 of the first coil layer 31 may be electrically connected to the first end portion 21*a* of the metal core 21 through the first through-via 33. The first through-via 33 may include a conductive material such as copper (Cu), aluminum (Al), silver (Ag), tin (Sn), gold (Au), nickel (Ni), lead (Pb), or alloys thereof, and may have a hourglass shape.

The second coil layer 41 may be disposed on the other surface of the support member 20, and may have a planar spiral shape having a plurality of coil turns. The second coil layer 41 may include a seed layer and a plating layer having a planar spiral shape. A material of each of the seed layer and the plating layer may be a conductive material such as copper (Cu), aluminum (Al), silver (Ag), tin (Sn), gold (Au), nickel (Ni), lead (Pb), or alloys, which is a general plating material. The second coil layer 41 may be formed by anisotropic plating technology. In this case, an aspect ratio (AR), which is a ratio of a height to a line width, may be implemented to have a high numerical value. Alternatively, the second coil layer 41 may be formed by forming one plating layer having a high aspect ratio using partition walls. The second coil layer 41 may have the second electrode portion 42 led out to the second surface of the body portion 10, and the second electrode portion 42 may be led out to the second surface of the body portion 10 to provide the second electrode surface 42M. The second electrode surface 42M may be electrically connected to the second external electrode 82 on the second surface of the body portion 10. The second electrode portion 42 of the second coil layer 41 may be electrically connected to the second end portion 21*b* of the metal core 21 through the second through-via 43. The second through-via 43 may include a conductive material such as copper (Cu), aluminum (Al), silver (Ag), tin (Sn), gold (Au), nickel (Ni), lead (Pb), or alloys thereof, and may have a hourglass shape.

Cavities 21*h* penetrating through the support member 20 may be formed between the coil turns of each of the first and second coil layers 31 and 41. Therefore, the support member 20 may also have a planar spiral shape corresponding to the planar spiral shape of each of the first and second coil layers 31 and 41. Side surfaces between the coil turns of each of the first and second coil layers 31 and 41 and walls of the cavities 21*h* of the support member 20 may be covered with an insulating film 60. Therefore, electrical insulation between coil patterns and between the coil patterns and the magnetic material of the body portion 10 may be possible.

A through-hole 21H penetrating through the support member 20 may be formed in a central portion, that is, a core region, of each of the first and second coil layers 31 and 41. The through-hole 21H may be filled with the magnetic material of the body portion 10, such that inductance characteristics of the coil component may be improved. An inner side surface of the central portion of each of the first and second coil layers 31 and 41 and walls of the through-hole 21H of the support member 20 may also be covered with the insulating film 60. Therefore, electrical insulation may also be possible.

The coil portion 70 may further include a via electrode 50 penetrating through the support member 20 and electrically connecting the first and second coil layers 31 and 41 to each other. The via electrode 50 may also include a conductive material such as copper (Cu), aluminum (Al), silver (Ag), tin (Sn), gold (Au), nickel (Ni), lead (Pb), or alloys thereof. The first and second coil layers 31 and 41 may be electrically connected to each other through the via electrode 50, such that the first and second coil layers having the planar spiral shape may implement coil characteristics of one power inductor.

The electrode portion 80 may serve to electrically connect the coil component 100 to the electronic device when the coil component 100 is mounted on the electronic device. The electrode portion 80 may include the first external electrode 81 and the second external electrode 82 disposed on the body portion 10 to be spaced apart from each other. The electrode portion 80 may further include pre-plating layers (not illustrated) disposed between the first external electrode 81, and the first electrode surface 32M and the first auxiliary electrode surface 21*a*M and between the second external electrode 82, and the second electrode surface 42M and the second auxiliary electrode surface 21*b*M, if necessary.

The first external electrode 81 may cover the first surface of the body portion 10 and extend to portions of the third surface, the fourth surface, the fifth surface, and the sixth surface of the body portion 10. The first external electrode 81 may be electrically connected to the first electrode portion 32 of the first coil layer 31 and the first end portion 21*a* of the metal core 21 led out to the first surface of the body portion 10. The first external electrode 81 may include, for example, a conductive resin layer and a conductor layer formed on the conductive resin layer. The conductive resin layer may be formed by printing paste, and may include one or more conductive metals selected from the group consisting of copper (Cu), nickel (Ni), and silver (Ag), and a thermosetting resin. The conductor layer may include one or more selected from the group consisting of nickel (Ni), copper (Cu), and tin (Sn). For example, a nickel (Ni) layer and a tin (Sn) layer may be sequentially formed in the conductor layer by plating.

The second external electrode 82 may cover the second surface of the body portion 10 and extend to portions of the third surface, the fourth surface, the fifth surface, and the sixth surface of the body portion 10. The second external electrode 82 may be electrically connected to the second electrode portion 42 of the second coil layer 41 and the second end portion 21*b* of the metal core 21 led out to the second surface of the body portion 10. The second external electrode 82 may include, for example, a conductive resin layer and a conductor layer formed on the conductive resin layer. The conductive resin layer may include one or more conductive metals selected from the group consisting of copper (Cu), nickel (Ni), and silver (Ag), and a thermosetting resin. The conductor layer may include one or more selected from the group consisting of nickel (Ni), copper (Cu), and tin (Sn). For example, a nickel (Ni) layer and a tin (Sn) layer may be sequentially formed in the conductor layer by plating.

Meanwhile, a case in which the electrode portion 80 is formed on the first and second surfaces of the body portion 10 is illustrated in the drawings, but the electrode portion 80 may be formed on the other surfaces or be formed on more surfaces, depending on a kind of coil component. In this case, dispositions of electrode surfaces of auxiliary electrode surfaces of the coil portion 70 may be correspondingly changed or added. In addition, if necessary, the coil portion 70 may include the support member 20, the first coil layer 31, the first through-via 33, and the insulating film 60, but may not include the second coil layer 41 and the second through-via 43.

Figure 6:
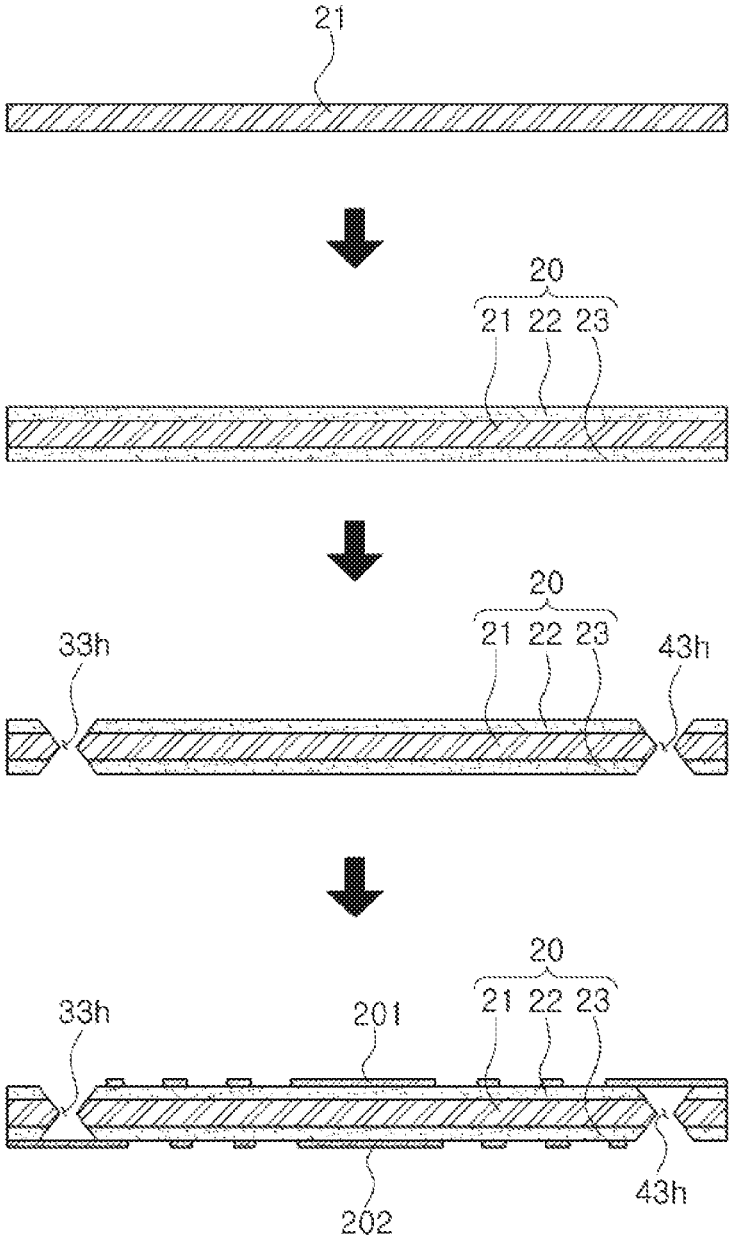
FIGS. 6 through 8 are schematic views illustrating an example of processes of manufacturing the coil component of FIG. 2.
Figure 7:
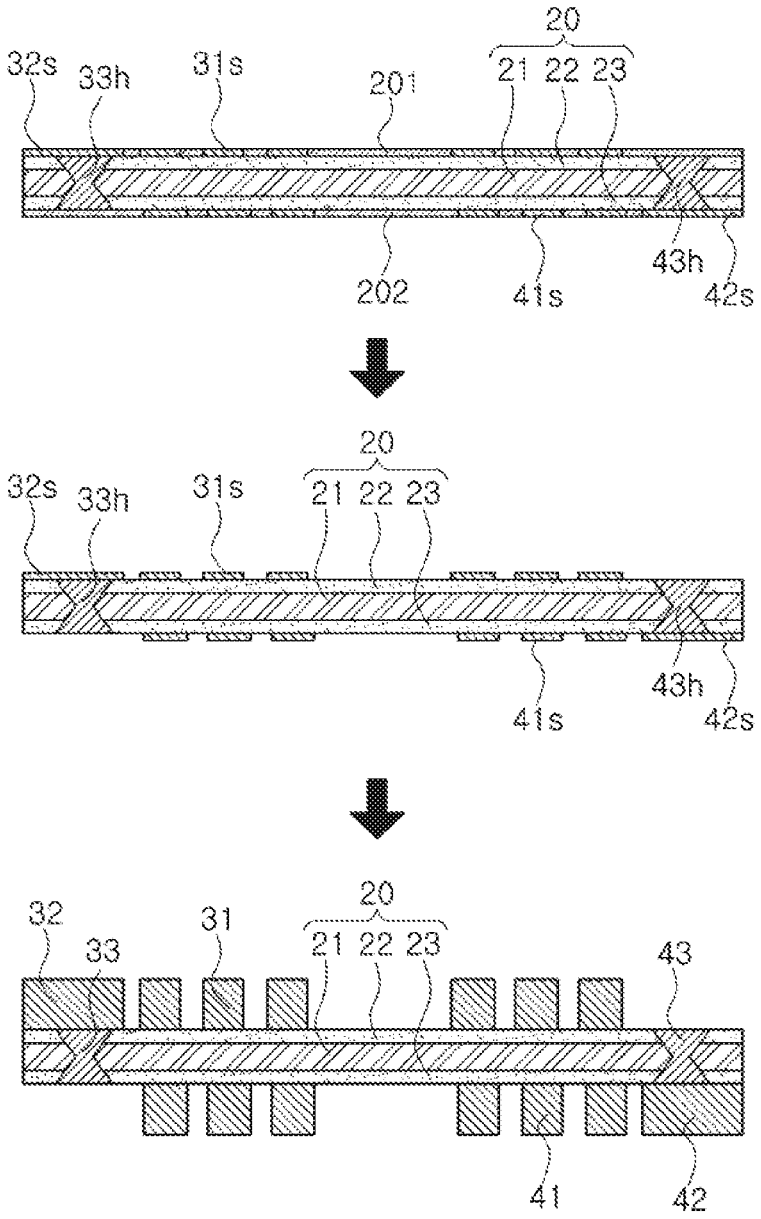
Figure 8:
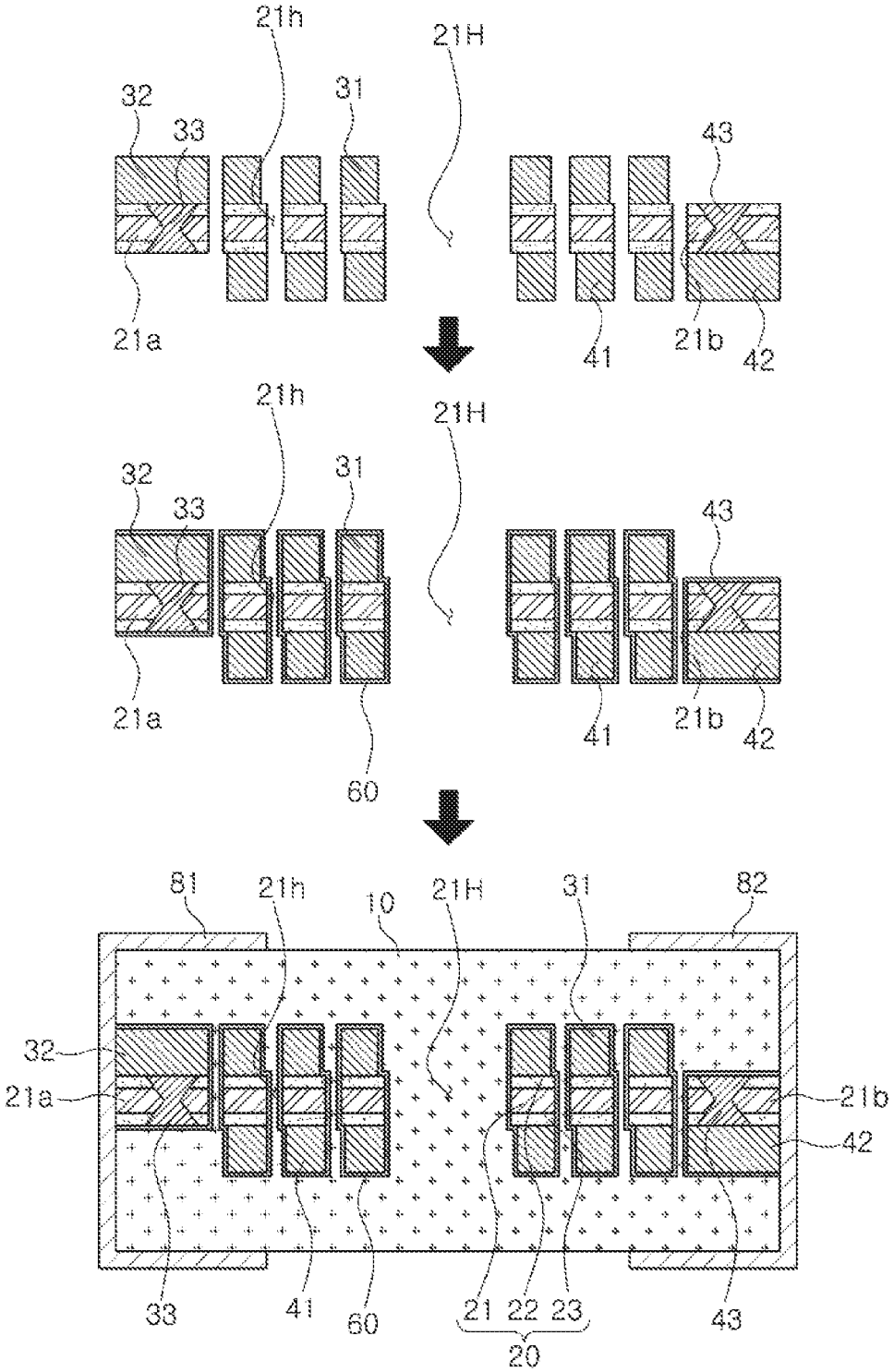

FIGS. 6 through 8 are schematic views illustrating an example of processes of manufacturing the coil component of FIG. 2.

Referring to FIG. 6, the metal core 21 may be first prepared. The metal core 21 may be, for example, a copper foil, or the like, but is not limited thereto. Then, the first and second insulators 22 and 23 may be applied to opposite surfaces of the metal core 21, respectively. The first and second insulators 22 and 23 may be maintained in a B-stage (ABF, prepreg (PPG), or the like). Then, first and second through-via holes 33*h* and 43*h* may be formed using a mechanical drill, a laser drill, or the like. Then, dry films 201 and 202 may be applied to the first and second insulators 22 and 23, respectively, and be then patterned by a photolithography method.

Then, referring to FIG. 7, pattern plating may be formed using the patterned dry films 201 and 202 to form first plating layers 31*s* and 32*s* and 41*s* and 42*s* for forming the first coil layer 31 and the second coil layer 41. In addition, in this process, the first and second through-via holes 33*h* and 43*h* may be filled out to form the first and second through-vias 33 and 43. The plating may be performed by chemical vapor deposition (CVD), physical vapor deposition (PVD), sputtering, a subtractive process, an additive process, a semi-additive process (SAP), a modified semi-additive process (MSAP), or the like. Then, the dry films 201 and 202 may be removed. The dray films 201 and 202 may be physically peeled off or be chemically etched to be removed. Then, the first coil layer 31 having the first electrode portion 32 and the second coil layer 41 having the second electrode portion 42 may be formed by anisotropic plating technology using the first plating layers 31*s* and 32*s* and 41*s* and 42*s*. However, the first coil layer 31 and the second coil layer 41 may also be formed by plating using partition walls, or the like, in addition to the anisotropic plating technology.

Referring to FIG. 8, the cavities 21*h* and the through-hole 21H may be formed. The cavities 21*h* and the through-hole 21H may also be formed using a laser drill and/or a mechanical drill. Then, the insulating film 60 may be formed. The insulating film 60 may be formed by CVD, or the like, using any known insulation coating material. Then, molded sheets including a magnetic material may be stacked, compressed, and hardened on upper and lower surfaces of the coil portion 70 to form the body portion 10. After the body portion 10 is formed, a process of dicing the body portion in each chip form may be performed although not illustrated in detail in the drawings. That is, a series of processes may be performed so that a plurality of coil portions 70 are formed using a support member 20 having a large area. Then, when a dicing process is performed, a plurality of body portions 10 each including the coil portions 70 may be obtained in the chip form. Then, a silicon coating process, a grinding process, or the like, may be performed. Then, when the electrode portion 80 is formed, the coil component 100 according to the exemplary embodiment described above may be manufactured.

As set forth above, according to the exemplary embodiment in the present disclosure, a coil component of which high reliability may be secured because a risk of an open defect may be suppressed even after a set is assembled may be provided.

While exemplary embodiments have been shown and described above, it will be apparent to those skilled in the art that modifications and variations could be made without departing from the scope of the present invention as defined by the appended claims.

What is claimed is:

1. A coil component comprising:

a body portion; and a coil portion disposed in the body portion, wherein the coil portion includes a support member and a first coil layer disposed on a first surface of the support member, the first coil layer including a first electrode portion led out to a first end surface of the body portion, the support member includes first and second insulators each having a composition different from the body portion, and a metal core disposed between the first and second insulators in a thickness direction, a first end portion of the metal core is led out to the first end surface of the body portion, and the coil portion further includes a first through-via penetrating through the support member and electrically connecting the first electrode portion of the first coil layer and the first end portion of the metal core to each other.

2. The coil component of claim 1, wherein the coil portion further includes a second coil layer disposed on a second surface of the support member opposing the first surface in the thickness direction and having a second electrode portion led out to a second end surface of the body portion opposing the first end surface, and a second end portion of the metal core is led out to the second end surface of the body portion.

3. The coil component of claim 2, wherein the coil portion further includes a second through-via penetrating through the support member and electrically connecting the second electrode portion of the second coil layer and the second end portion of the metal core to each other.

4. The coil component of claim 3, wherein each of the first and second through-vias has an hourglass shape.

5. The coil component of claim 2, wherein each of the first and second coil layers has a planar spiral shape having a plurality of coil turns.

6. The coil component of claim 5, wherein cavities penetrating through the support member are disposed between the coil turns of each of the first and second coil layers.

7. The coil component of claim 6, wherein the metal core of the support member has a planar spiral shape corresponding to the planar spiral shape of each of the first and second coil layers.

8. The coil component of claim 6, wherein side surfaces between the coil turns of each of the first and second coil layers and walls of the cavities of the support member are covered with an insulating film.

9. The coil component of claim 5, wherein a through-hole penetrating through the support member is disposed in a central portion of each of the first and second coil layers.

10. The coil component of claim 9, wherein an inner side surface of the central portion of each of the first and second coil layers and walls of the through-hole of the support member are covered with an insulating film.

11. The coil component of claim 2, wherein the coil portion further includes a via electrode penetrating through the support member and electrically connecting the first and second coil layers to each other.

12. The coil component of claim 2, further comprising an electrode portion disposed on the body portion, wherein the electrode portion includes a first external electrode disposed on the first end surface of the body portion and a second external electrode disposed on the second end surface of the body portion, the first external electrode is electrically connected to the first electrode portion of the first coil layer and the first end portion of the metal core, and the second external electrode is electrically connected to the second electrode portion of the second coil layer and the second end portion of the metal core.

13. The coil component of claim 1, wherein each of the first and second insulators includes an insulating resin and an inorganic filler, and the metal core includes copper (Cu).

14. The coil component of claim 13, wherein each of the first and second insulators further includes a glass fabric.

15. The coil component of claim 1, wherein a first electrode surface and a first auxiliary electrode surface, spaced apart from each other, are exposed to the first end surface of the body portion, the first electrode surface is a surface to which the first electrode portion of the first coil layer is exposed, and the first auxiliary electrode surface is a surface to which the first end portion of the metal core is exposed.

16. The coil component of claim 2, wherein a second electrode surface and a second auxiliary electrode surface spaced apart from each other are exposed to the second end surface of the body portion, the second electrode surface is a surface to which the second electrode portion of the second coil layer is exposed, and the second auxiliary electrode surface is a surface to which the second end portion of the metal core is exposed.

17. The coil component of claim 1, wherein the metal core is spaced apart from the first coil layer in the thickness direction by at least one of the first and second insulators having the composition different from the body portion.

18. A coil component comprising:

a body portion; and a coil portion disposed in the body portion, wherein the coil portion includes a support member and a first coil layer disposed on a first surface of the support member, the first coil layer including a first electrode portion led out to a first end surface of the body portion, the support member includes first and second insulators and a metal core disposed between the first and second insulators, a first end portion of the metal core is led out to the first end surface of the body portion, and the coil portion further includes a through-via penetrating through the support member and electrically connecting the first electrode portion of the first coil layer and the first end portion of the metal core to each other.

19. The coil component of claim 18, wherein the metal core has a planar spiral shape.

* * * * *